United States Patent [19]

Henry

[11] 4,063,679

[45] Dec. 20, 1977

[54] CARTON WITH TRIANGULAR SIDES

[75] Inventor: James W. Henry, Jacksonville, Fla.

[73] Assignee: Potlatch Corporation, San Francisco, Calif.

[21] Appl. No.: 679,069

[22] Filed: Apr. 21, 1976

[51] Int. Cl.[2] ..... B65D 5/36

[52] U.S. Cl. ..... 229/41 C; 229/37 R; 229/16 R

[58] Field of Search ..... 229/41 C, 41 D, 41 B, 229/41 R, 16 R, 37 R

[56] References Cited

U.S. PATENT DOCUMENTS

| | | | |
|---|---|---|---|
| 2,020,353 | 11/1935 | Brown | 229/41 C X |
| 2,031,806 | 2/1936 | Weiss | 229/41 C X |
| 2,808,193 | 10/1957 | Michalka | 229/41 C X |
| 2,826,350 | 3/1958 | Marx | 229/37 R |
| 3,079,062 | 2/1963 | Craddock et al. | 229/16 R |
| 3,100,072 | 8/1963 | Mason | 229/16 R |
| 3,122,298 | 2/1964 | Seger, Jr. | 229/16 R |
| 3,174,675 | 3/1965 | Rosenburg, Jr. | 229/41 C |
| 3,369,727 | 2/1968 | Wright | 229/16 R X |
| 3,912,156 | 10/1975 | May | 229/37 R |

FOREIGN PATENT DOCUMENTS

| | | | |
|---|---|---|---|
| 1,124,422 | 2/1962 | Germany | 229/41 C |

*Primary Examiner*—Davis T. Moorhead
*Attorney, Agent, or Firm*—Jack E. Dominik

[57] ABSTRACT

A knock-down folding carton is disclosed having a top closure and a bottom closure, shown with a top tab type closure and an automatic bottom, in which the sides are a plurality of sets of isosceles triangular members, half of which have their bases defining the top closure opening, and half of them having their bases defining the bottom. The top closure is oriented on a diagonal of the bottom closure as a result of the side wall configuration. Optionally, drop flaps can be employed on the top closure so that the only raw edge presented is at the end where the tab is inserted. In addition, a double bottom can be employed. While the configuration shown is primarily square in cross-section, other uniform cross-sections such as hexagonal, and octagonal are shown.

14 Claims, 20 Drawing Figures

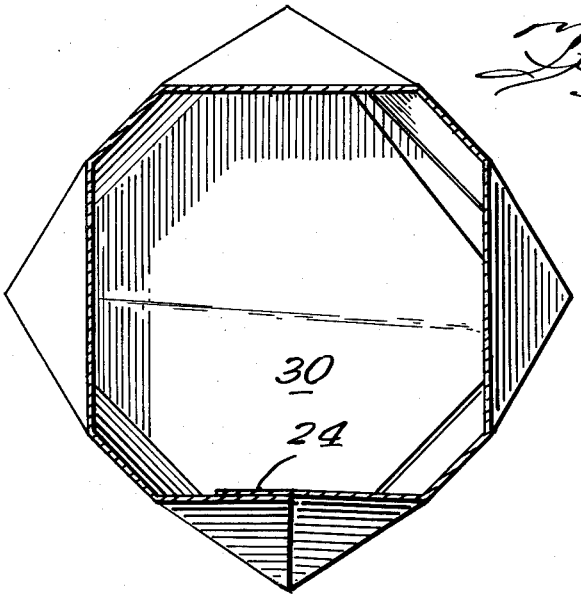
Fig. 10.
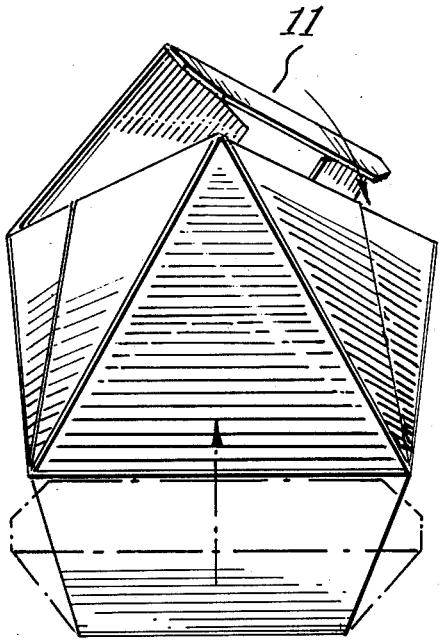
Fig. 11.
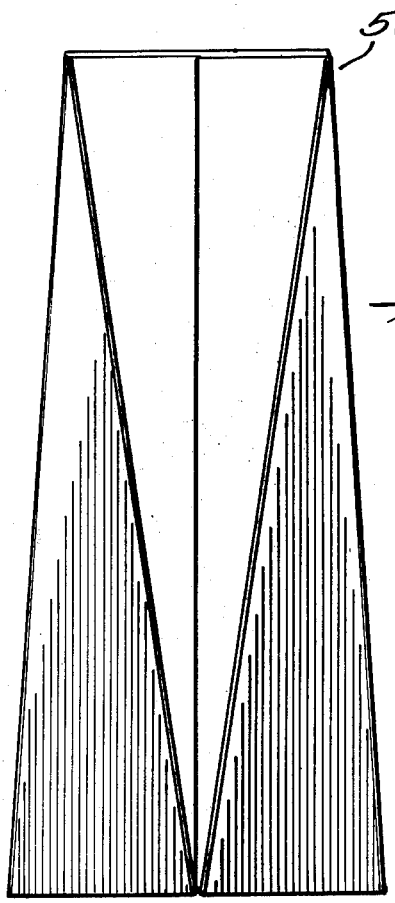
Fig. 12a.
Fig. 12b
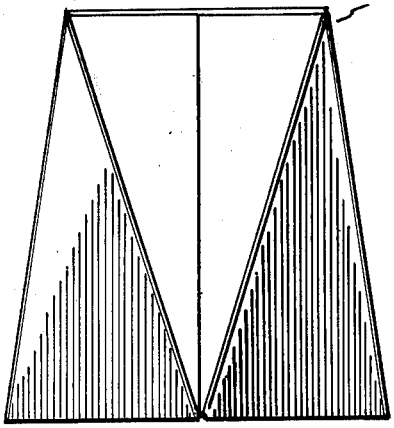
Fig. 12c.
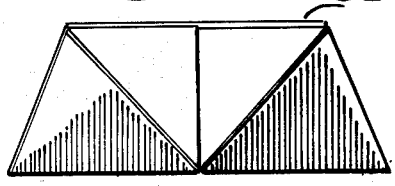

Fig. 13
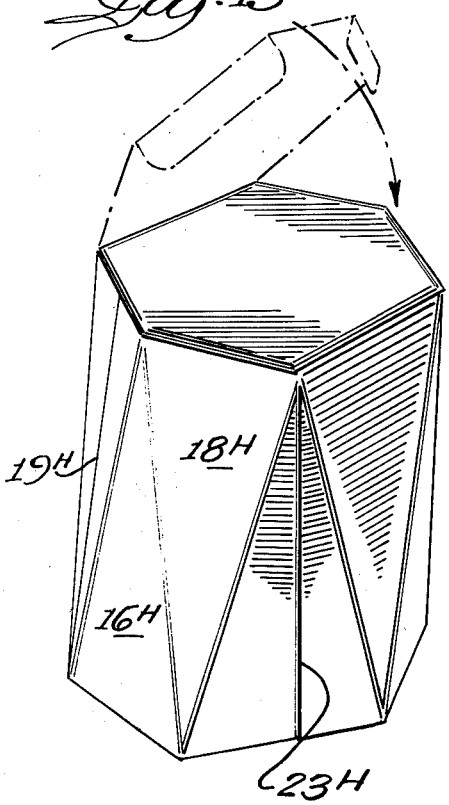
Fig. 14
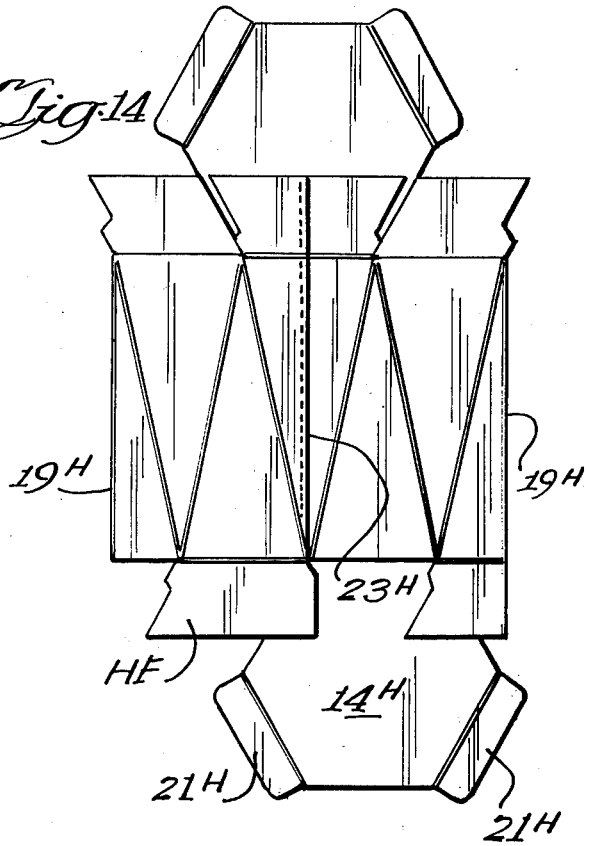
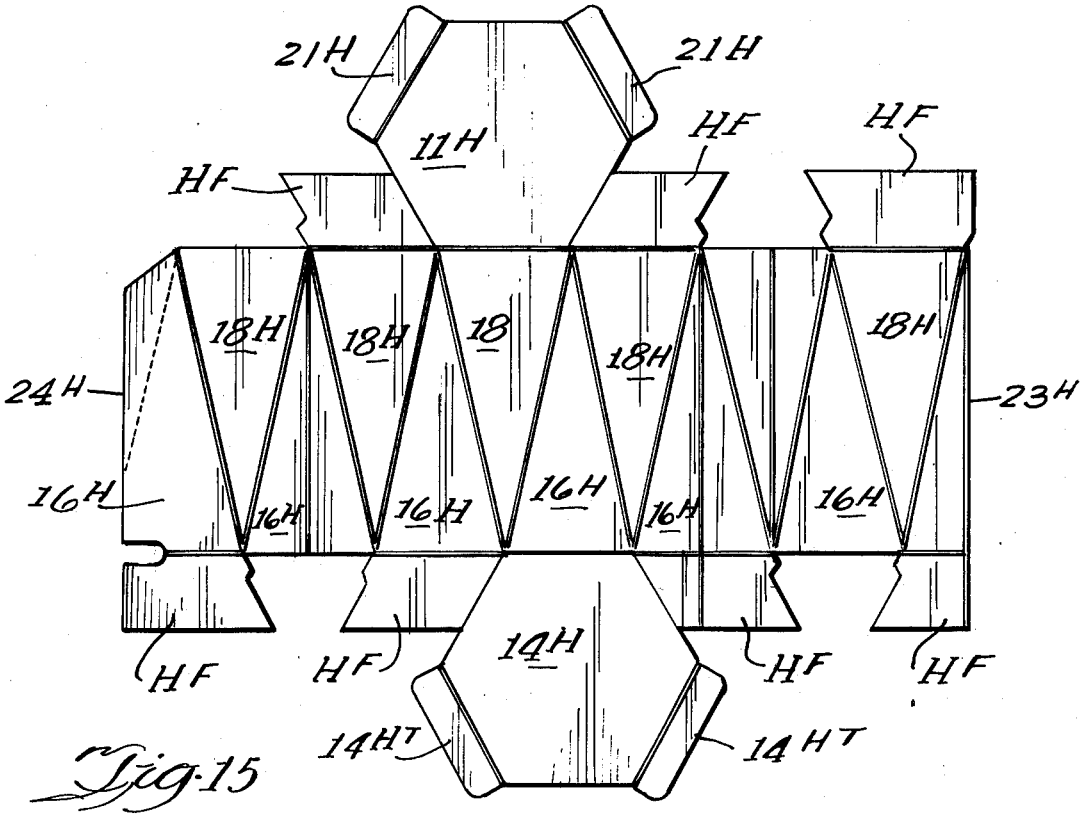
Fig. 15

Fig. 16
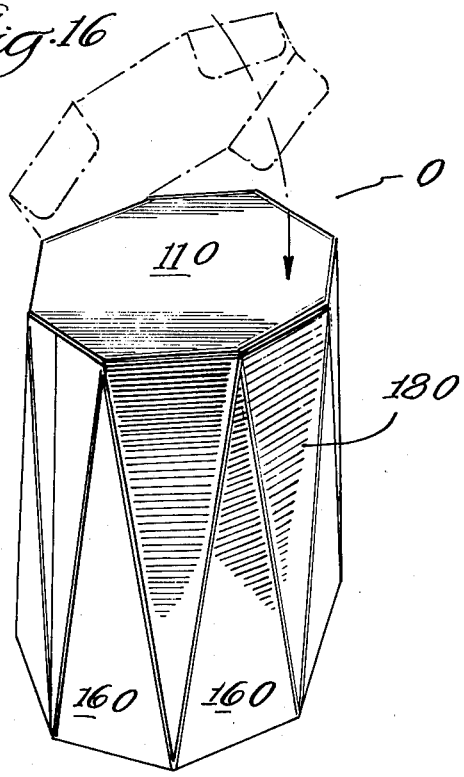
Fig. 17
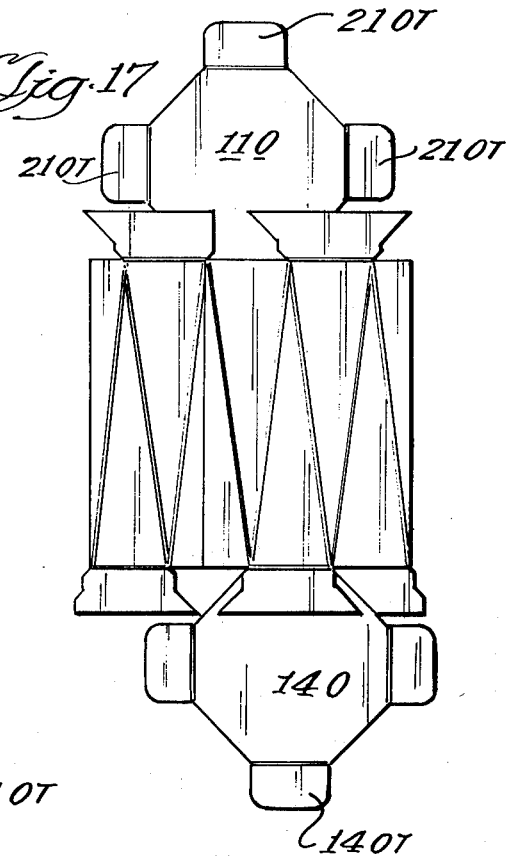
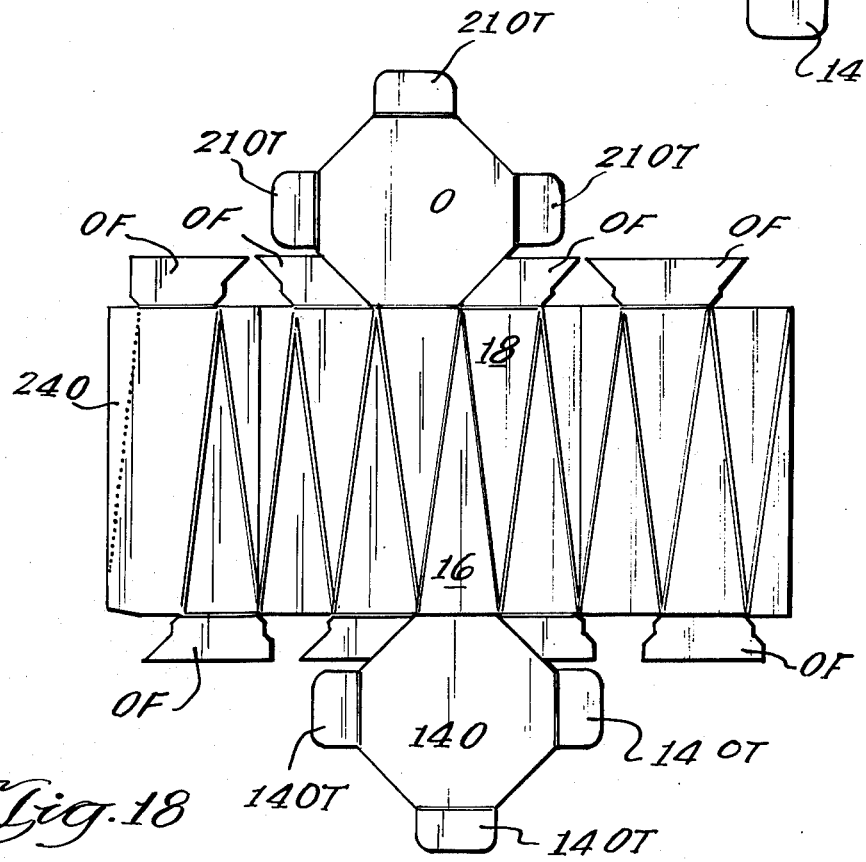
Fig. 18

CARTON WITH TRIANGULAR SIDES

FIELD OF INVENTION

The present invention relates primarily to folding cartons which can be knocked down flat for shipment, and which generally are formed from paperboard, printed on the outside, and can be erected by hand. More particularly, the subject matter is directed to a carton having sides which are not rectangular, but rather triangular.

SUMMARY OF THE PRIOR ART

The prior art cannot be adequately summarized through a list of patents, or indeed, a description of knock-down folding cartons. The prior art is primarily the subject matter of containerization through a knock-down carton, and one having a construction which is unique in appearance, strong from a standpoint of vertical crushing strength, and yet capable of being shipped in the knock-down configuration.

Particularly difficult in the folding carton field is the formation of a carton having more than four sides. Indeed, hat boxes, and many other configured boxes are set-up boxes because of a circular cross-section. When it is recognized that in theory, a circle is nothing but a square with an infinite number of sides, by providing more sides than four, a knock-down carton can be substituted for certain round cartons which are set-up, thereby effecting significant economy.

SUMMARY

The present invention stems from the discovery that by utilizing isosceles triangular side panels in a knock-down folding carton, and orienting the top closure along a diagonal of the bottom closure, that a sturdy carton can be constructed, and one with several sides, and yet the construction adaptable to a wide variety of width-to-height ratios. The isosceles triangular side walls are oriented in two sets, one set having their base portions defining the top closure, and the other and immediately adjacent set defining the bottom closure by their bottom or base portion. The top closure is desirably one with a top tab, and side drop flaps to the end that the only raw board exposed is on one face. The bottom closure may be an automatic bottom, double-walled for additional strength. The glue flap is desirably at a median of the triangle opposite the hinged edge of the top, so that when the tab is inserted its adjacent raw edge and the raw edge of the glue flap are all on one panel, the balance of the triangles and panels being uninterrupted and not having exposed raw edges. Principally, the construction is square as to the top and bottom, but optionally hexagonal and octagonal configurations may be formed as shown.

In view of the foregoing, it is a principal object of the present invention to construct a knock-down folding carton which has a plurality of triangular sides.

A further object of the present invention is to provide a knock-down folding carton which, because of its utilization of triangular elements, is rigid and sturdy and resists compressive loading.

Still another object of the present invention is to provide a knock-down folding carton with a plurality of triangular sides, the cost of which is competitive with other cartons, and does not consume an inordinate amount of board for the cube content of the fully erected and closed box.

Still another object of the present invention is to provide a knock-down folding carton construction achieving all of the above objectives, and susceptible of a wide variety of width-to-height ratios, as well as number of side panels.

DESCRIPTIVE DRAWINGS

Further objects and advantages of the present invention will become apparent as the following description of the product takes place, taken in conjunction with the accompanying illustrative drawings in which:

FIG. 10 is a transverse sectional view of the carton shown in FIG. 1 taken along section line 10—10 of FIG. 1.

FIG. 11 is a bottom perspective view of the carton illustrating the diagonal relationship between the top closure opening and the bottom opening.

FIGS. 12 *a, b* and *c* are illustrative of three sequential cartons manufactured in accordance with the present invention in which the height to width ratio varies significantly.

FIG. 13 discloses in perspective an illustrative carton having an hexagonal configuration of both the top and the bottom.

FIG. 14 is a plan view of the carton of FIG. 13 in its knockdown configuration.

FIG. 15 is a plan view of the panel from which the carton of FIGS. 13 and 14 is formed.

FIG. 16 is a perspective view of a further alternative embodiment carton in which an octagonal top is employed.

FIG. 17 is a plan view of the carton of FIG. 16 in its knockdown condition.

FIG. 18 is a plan view of the panel from which the cartons of FIGS. 16 and 17 having an octagonal top and bottom is formed.

DESCRIPTION OF ILLUSTRATIVE EMBODIMENTS

Figure 1:
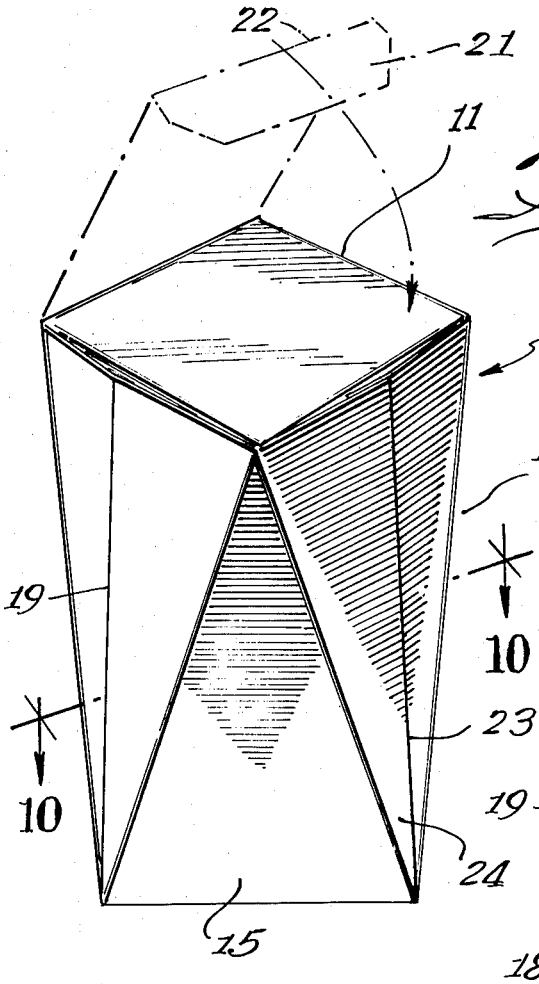
FIG. 1 is a perspective view of an exemplary carton having a plurality of triangular sides, showing in phantom lines the orientation for the top closure.
Figure 2:
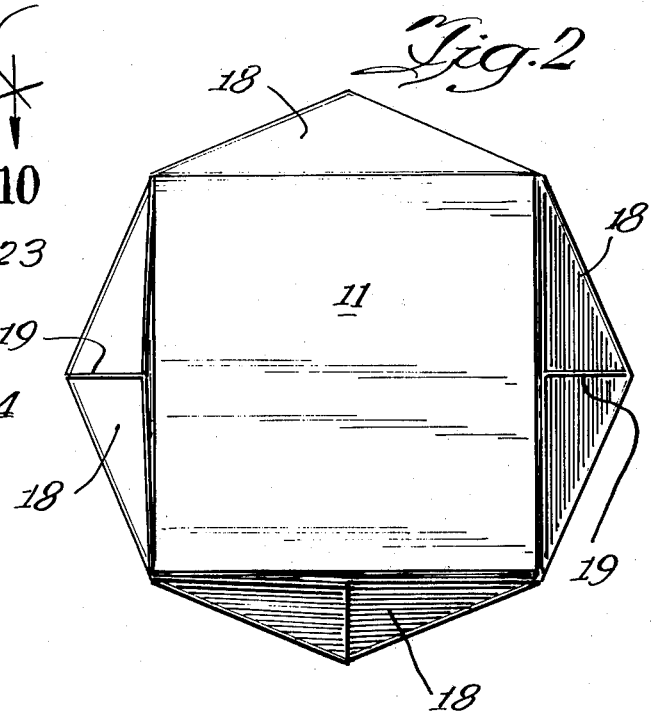
FIG. 2 is a top view of the carton shown in FIG. 1.
Figure 3:
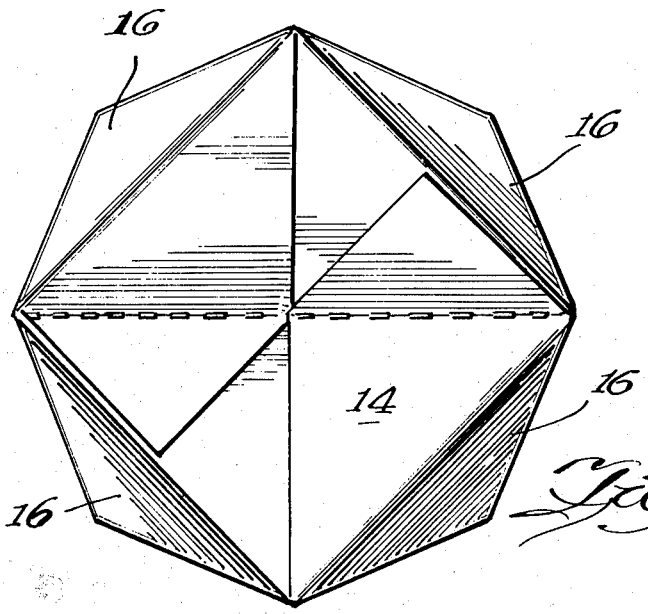
FIG. 3 is a bottom view of the carton shown in FIG. 1.

An illustrative embodiment of a carton 10 employing the subject matter of the invention is shown in FIGS. 1, 2 and 3, being respectively a perspective view, bottom view, and top view. In FIGS. 1 and 2 it will be seen that the top 11 is square, and removably folds into place. The side walls 12 of the carton are made up of a plurality of isosceles triangular portions 15, as noted in FIG. 1. More specifically, it will be seen in FIG. 3 that the bottom 14 is surrounded by four isosceles triangular side walls being collectively the base set 16 of isosceles triangular portion. Shown in FIG. 2 are the four top sets 18 of the isosceles triangular sections 15. Taken together, there are eight separate isosceles triangular portions of our panels 15 in a carton having a square top 11 and square bottom 14. The only indicia appearing on the carton 10 identifying it as a knock-down or folding carton are the creases 19 which are on two opposed isosceles triangular panels, in this instance on the top set 18, as well as the raw edge 23 defined by the glue flap 24. Before describing in detail the particular elements of the exemplary carton, it should be noted in FIGS. 12*a*, 12*b* and 12*c* that varying height-to-width ratios may be employed in a carton having the construction exemplary of the present invention. For example, the carton shown in FIG. 12*a* may be suitable for packaging a quart bottle of spirits, with its height being somewhat more than twice its width. In the carton of FIG. 12*b*, the height and width are approximately the same. In the carton of FIG. 12*c*, the height is less than one-half the width, and a carton similar to the one shown in 12*c* will be described as the description of a particular panel takes place. Thus irrespective of whether the carton is a tall carton 50, a medium carton 51, or a short carton 52, the essential elements including the isosceles triangles 15, the top 11, and the bottom 14 have the same general construction.

Figure 4:
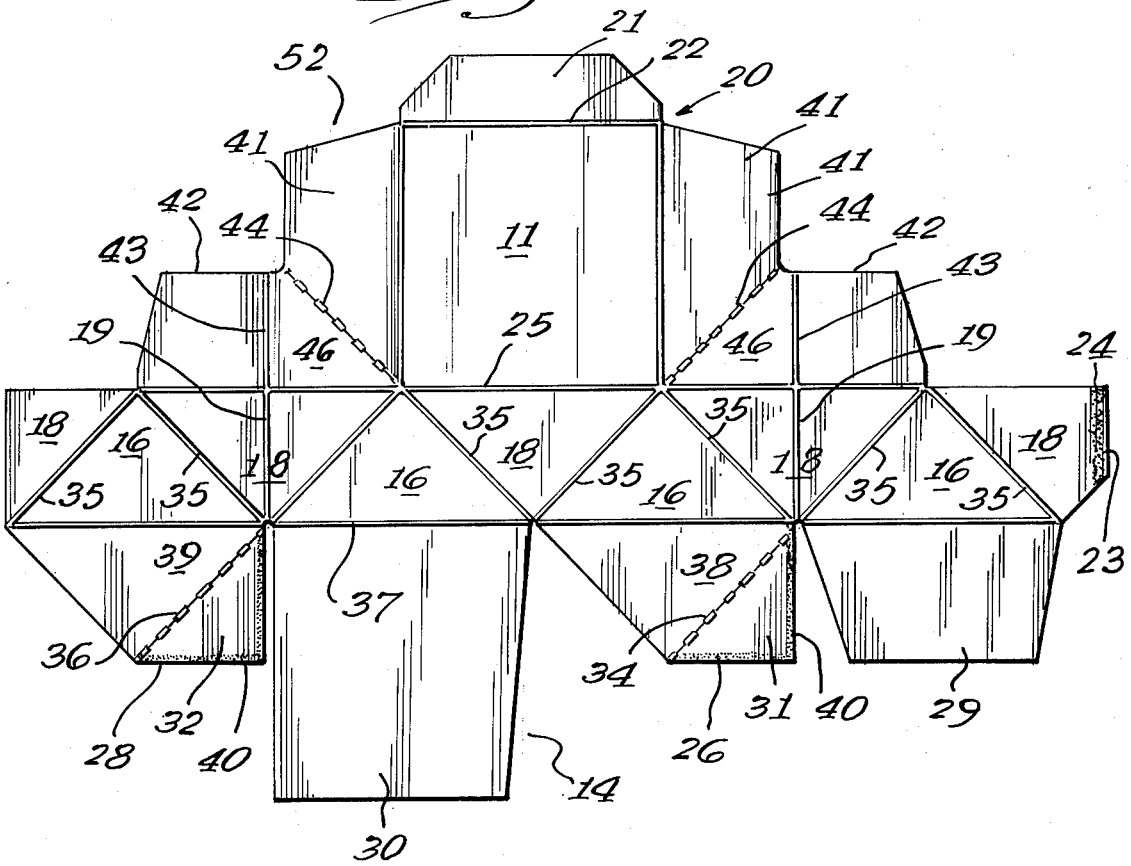
FIG. 4 is a plan view of the panel of paperboard from which the exemplary carton is manufactured, however the panel shown in FIG. 4 has a shallow height compared to the panels employed in the cartons shown in FIGS. 1, 2 and 3, but nontheless all the same elements.

Turning now to FIG. 4, it will be seen that the panel 20 for the short carton 52 starting from the upper portion of the panel includes a rectangular top 11, joined by a tab hinge or crease line 22 to the tuck tab 21. A top hinge 25 joins the opposite portion of the top 11 to one of the members of the top set 18 of the isosceles triangles 15. The base set 16 and top set 18 of the isosceles triangular portions 15, some eight in number, can be seen running from left to right in the midportion of the panel 20 terminating at the extreme end in a glue flap 24, which overlaps and secures two half portions of one of the isosceles triangles 15 belonging to the top set 18.

The bottom shown in an automatic bottom 14, made up of two bottom actuators 26, 28 and a partial closure portion 29, overlapped interiorly by a full bottom 30. Tug tabs 31, 32 are triangular members joined by tug tab hinges to the tug tab bases 38, 39 of the bottom actuators 26. Bottom hinges 37 join all of the members of the automatic bottom to their adjacent isosceles triangles 15 of the base set 16. The balance of the isosceles triangular sets 16, 18 are joined to each other by means of triangle creases 35. The automatic bottom is actuated by the glue edges 40 of the tug tabs 31, 32 where they are secured to adjacent bottom members.

In order to avoid raw edges adjacent the top 11, top drop flap 41 is provided along the sides of the top 11, and in addition side drop flaps 42 are joined to adjacent isosceles triangles 15 of the top set 18. A drop flap crease 43 which is an extension of the side crease 18 determines the portion of the top flaps which fold when the carton is in its knock down condition. The side drop flaps and top drop flaps are joined by means of a drop flap hinge which is an extension of one of the side walls of two adjacent isosceles portions 15 of the base set 16 of isosceles trapezoidal sections.

Figure 5:
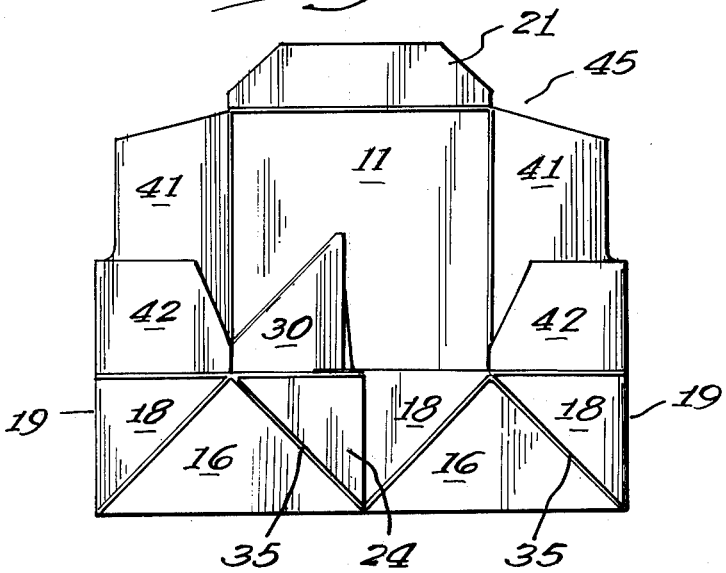
FIG. 5 is a sequential view of the panel of FIG. 4 showing the same after the carton has been glued and manufactured, and is ready for setup.

The subject short carton 52 is shown in its folded or knocked down configuration in FIG. 5, where the elements just described can be observed where they are visible.

Figure 6:
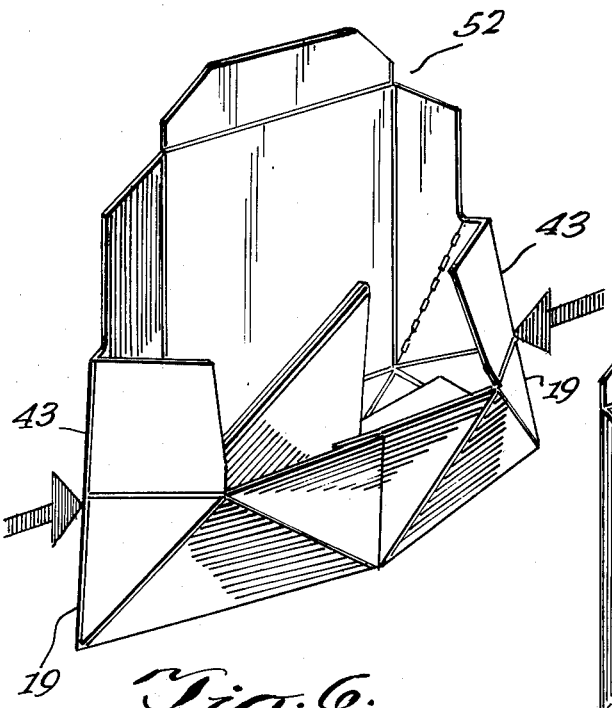
FIG. 6 is a partially perspective view of the carton shown in FIG. 5 illustrating by the arrows shown therein the initial step for erecting the carton.

To open the carton 52 from the configuration shown in knocked down form in FIG. 5, the same is pressed from both sides as indicated by the arrow in FIG. 6 along the crease 19 and its extension in the form of the drop flag crease 43. At this time the elements of the automatic bottom 14 begin to fold interiorly of the carton 52.

Figure 7:
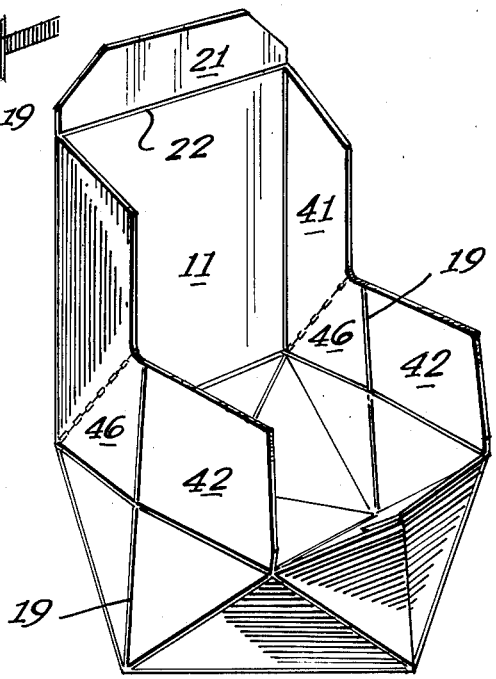
FIG. 7 is a sequential view from that shown in FIG. 6 illustrating the configuration of the carton after the crease lines have been moved into a central location.
Figure 8:
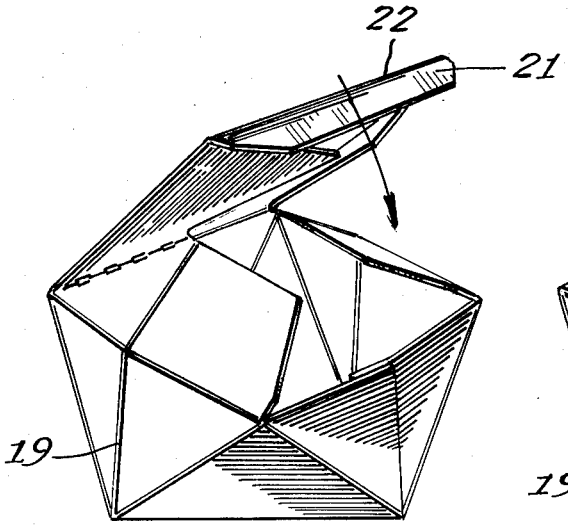
FIG. 8 is a further sequential view of the carton shown in FIG. 7 with the top being folded into the closed position.
Figure 9:
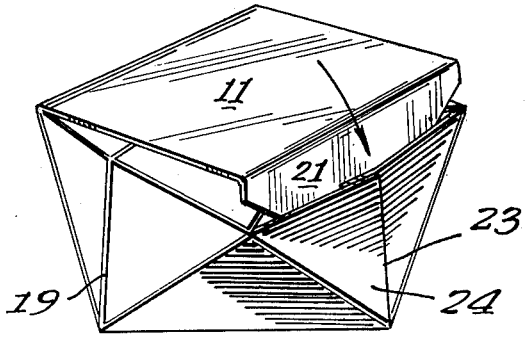
FIG. 9 is a final view just prior to total closure of the top sequentially taken after that shown in FIG. 8.

Thereafter the carton assumes the erect configuration of FIG. 7, awaiting the closure of the top 11. The top 11 is closed by means of pressing inwardly on the triangular corner 46 which joins the top drop flap 41, and the side drop flag 42. The drop flaps then move inwardly as shown in FIG. 8, and when the tuck tab 21 is folded inwardly, as shown in FIG. 9, the only raw edges which are exposed are the upper edge of the isosceles triangle 15 which includes the raw edge 23 of the glue flap 24, the balance of the side walls of the top 11 being folded edges, as well as the hinge 22 of the tuck tab 21.

Completing the structural integrity of the carton 10, is the full bottom 30 shown in its final position in FIG. 10, a cross-section looking downwardly into the carton 10. The action of closing the top 11 is shown from an underneath view in FIG. 11. In both FIGS. 10 and 11, it becomes quite clear that after the carton is erected, the top and bottom are oriented respectively along diagonals of the other, and the entire side wall 12 is defined by the eight isosceles triangles.

As pointed out in the objects above, the subject carton may be formed with an hexagonal or octagonal top and bottom. Indeed, additional numbers of sides on the top and bottom can be developed just so long as symmetry is preserved. By way of illustration, it should be noted that the hexagonal carton H shown in FIG. 13, includes an upper set of isosceles triangular members 18H, and a lower set of isosceles members 16H. As shown in the balance of the drawing, the same reference numerals as appearing in FIGS. 1 through 12 will be employed, distinguishing the alternative construction by the suffix H for "hexagonal" and O for "octagonal". Continuing further with the carton shown in FIG. 13, it will be seen that the raw edge of the glue seam 24H (see FIG. 15) is positioned as a median portion of one of the lower triangles 16H as shown at 23H in FIG. 13. The top 11H has a pair of side tabs 21H which tuck into the slots defined by the end portion of the hexagonal top flaps HF as shown particularly in FIGS. 14 and 15. To be noted is that the top flaps HF comprise a pair immediately adjacent the top 11H, and then at the bottom is a pair of flaps HF immediately adjacent the bottom flap 14H and a pair remote from the top 11H. In each instance, the top flaps HF are provided with notches at their end portions which permit the ingress of the top tabs 21H when the carton is folded into its closed configuration. Unlike the construction shown in FIGS. 1 through 12 with the square top and bottom, the bottom portion of the hexagonal carton H is substantially identical and virtually a mirror image of the top portion. This will be observed in FIGS. 14 and 15.

Illustrative of the octagonal top and bottom construction is the octagonal cross-section carton O shown in FIG. 16 through 18. There it will be seen that the top 11O is octagonal in cross-section, having three tabs 21OT. The phantom lines in FIG. 16 disclose how the top is closed, and the configuration of the top flaps 21OT as shown in FIGS. 17 and 18. The top 11O and the bottom 14O of the octagonal carton O are substantially identical and mirror images each of the other, just as discussed with regard to the top and bottom of the hexagonal carton H.

The knockdown configuration as shown in FIG. 17 is substantially the same for the octagonal carton O as it is for the hexagonal carton H as shown in FIG. 14. In each instance the upper set of triangles 18 and the lower set 16 are twice the number of the sides of the top and bottom, thus in the hexagonal carton H there are twelve side panels of isosceles triangular configuration, whereas with the octagonal carton O, there are sixteen isosceles triangular portions 16, 18, closely approaching a circular or cylindrical cross-section.

It will be appreciated that when the hexagonal carton H is employed, the same can be used to restrain an interiorly held member with an odd shape, depending upon where it is positioned. For example, a bottle with a triangular cross-section may be placed in the hexagonal carton H and secure some orientation against rotation.

On the other hand, the octagonal carton O approaching a cylinder in cross-section, may be employed for packaging cylindrical items such as a skein of yarn, or when the height and width is approximately the same, can serve as a hat box, or for the storage of other items which are substantially circular in cross-section. The distinct advantages of the construction shown both as to the hexagonal carton H and the octagonal carton O is the resistance to compression loading because of the numbers of isosceles triangles 16, 18 on the sides, as well as the interlocking of the tops 11 and the bottom 14. Furthermore, the economies achieved over a set-up box of circular cross-section are substantial in view of eliminating the necessity of setting up the box until such time as it is to serve as an ultimate package for the customer.

Although particular embodiments of the invention have been shown and described in full here, there is no intention to thereby limit the invention to the details of such embodiments. On the contrary, the intention is to cover all modifications, alternatives, embodiments, usages and equivalents of a carton with triangular sides as fall within the spirit and scope of the invention, specification and the appended claims.

What is claimed is:

1. A knock down folding carton having a planar top closure oriented diagonally with a planar bottom closure comprising, in combination,
- a planar top closure,
- a planar bottom closure,
- a plurality of sequential isosceles triangular side wall portions each having a base and a vertex,
- said isosceles triangular side wall portions being alternately inverted with relationship to the adjacent isosceles triangular side wall portion thereby forming top and bottom sets,
- the bases of one set of isosceles side wall portions defining the planar bottom closure perimeter and the bases of the other set defining the planar top closure perimeter, whereby the opposed triangle bases define a carton with a top and bottom with each diagonally opposed to the other and whereby said carton is free standing on its bottom and top.

2. In the carton of claim 1,
- said top and bottom having a square configuration.

3. In the carton of claim 1,
- said top and bottom having a hexagonal configuration.

4. In the carton of claim 1,
- said top and bottom having a octagonal configuration.

5. A knock down folding carton having a top closure oriented diagonally with the bottom closure comprising, in combination,
- a blank form having not less than 10 even numbered faces,
- a top closure face,
- a bottom closure face,
- a plurality of isosceles triangular side wall face portions each having a base and a vertex,
- said side wall face portions being alternately inverted with relationship to the adjacent side wall face portion thereby forming top and bottom sets,
- the bases of one set of isosceles side wall face portions defining the bottom closure perimeter and the bases of the other set defining the top closure perimeter, whereby the opposed triangle bases define a carton with a top and bottom with each diagonally opposed to the other.

6. In the carton of claim 5,
- said top and bottom having a square configuration.

7. In the carton of claim 5,
- said top and bottom having an hexagonal configuration.

8. In the carton of claim 5,
- said top and bottom having an octagonal configuration.

9. A knock down folding carton having a top closure oriented diagonally with the bottom closure comprising, in combination,
- a multi-sided top closure,
- a multi-sided bottom closure
- said top and said bottom having at least four sides, said sides being even in number,
- a plurality of isosceles triangular side wall portions each having a base and a vertex,
- said side wall portions being alternately inverted with relationship to the adjacent side wall portion thereby forming top and bottom sets,
- the bases of one set of isosceles side wall portions defining the bottom closure perimeter and the bases of the other set defining the top closure perimeter, whereby the opposed triangle bases define a carton with a top and bottom with each diagonally opposed to the other.

10. In the carton of claim 9,
- said bottom being of automatic construction with an inner flap covering substantially the bottom closure area.

11. In the carton of claim 9,
- one opposed pair of isosceles triangles in one set having median crease lines, whereby the carton is pre-glued and folded flat with the crease lines defining the edges of the flattened carton.

12. In the carton of claim 9,
- said top having a hinged edge and oppositely disposed closure tab,
- a glue flap at the median of the triangle opposite the hinged edge of the top, and
- drop flaps at the side edges of the top closure joined to drop flaps on the edges of the bases of the isosceles panels extending from the top closure hinge, whereby the only raw edges appear at the glue seam and the base of its isosceles triangle which abuts the closure tab.

13. In the carton of claim 9, said top and bottom having a square configuration.

14. In the carton of claim 9, said bottom being of automatic construction with an inner flap covering substantially the bottom closure area.

* * * * *